United States Patent [19]

Giguére

[11] 4,199,137

[45] Apr. 22, 1980

[54] APPARATUS FOR FOOT REHABILITATION

[76] Inventor: André M. Giguére, 2625 Régina St., Apt. 1008, Ottawa, Ontario, Canada

[21] Appl. No.: 840,413

[22] Filed: Oct. 7, 1977

[51] Int. Cl.[2] ..... A63B 23/04

[52] U.S. Cl. ..... 272/96; 128/25 B; 272/132; 272/DIG. 5; 403/144

[58] Field of Search ..... 272/96, 146, DIG. 5, 272/DIG. 6, 131, 132; 128/25 B; 403/138, 144

[56] References Cited

U.S. PATENT DOCUMENTS

| | | | |
|---|---|---|---|
| 478,166 | 7/1892 | Madsen | 128/25 B |
| 1,509,793 | 9/1924 | Thompson | 272/96 |
| 1,531,670 | 3/1925 | Levy | 272/96 |
| 1,535,391 | 4/1925 | Anderson | 272/132 |
| 2,035,549 | 3/1936 | Jones | 272/96 |
| 2,256,763 | 9/1941 | Reed | 403/138 |
| 2,720,396 | 10/1955 | Pfaus | 272/DIG. 5 |
| 2,906,573 | 9/1959 | Runton | 403/144 |
| 3,134,591 | 5/1964 | Conn | 272/146 |
| 3,428,311 | 2/1969 | Mitchell | 272/67 |
| 3,525,522 | 8/1970 | Piller | 272/96 |
| 3,640,530 | 2/1972 | Henson | 272/DIG. 5 |
| 3,782,721 | 1/1974 | Passera | 272/132 |

*Primary Examiner*—Richard J. Johnson
*Attorney, Agent, or Firm*—Quaintance, Murphy & Richardson

[57] ABSTRACT

At the time of a twist or a bone fracture of the ankle it is necessary after the plastering to reeducate the ankle motions. In the present invention, a footrest is fastened on a base and may pivot on the base by means of a ball-and-socket joint. Various settings allow this pivoting to be progressive and measured so that the patient or the doctor may follow the reeducation progress, day by day.

20 Claims, 6 Drawing Figures

FIG.I
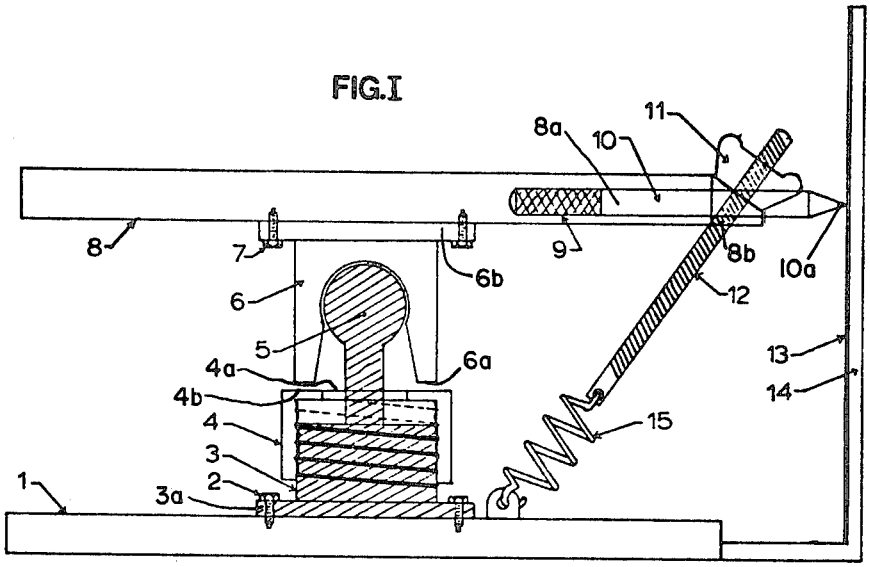
FIG.II
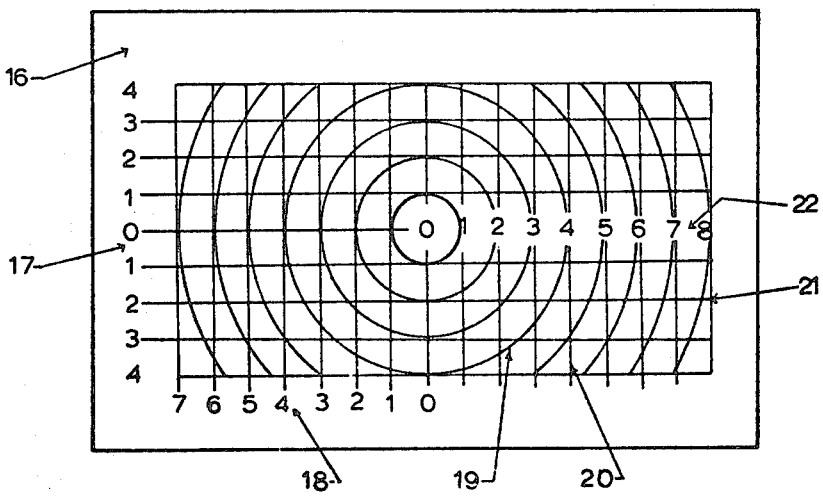

FIG. III
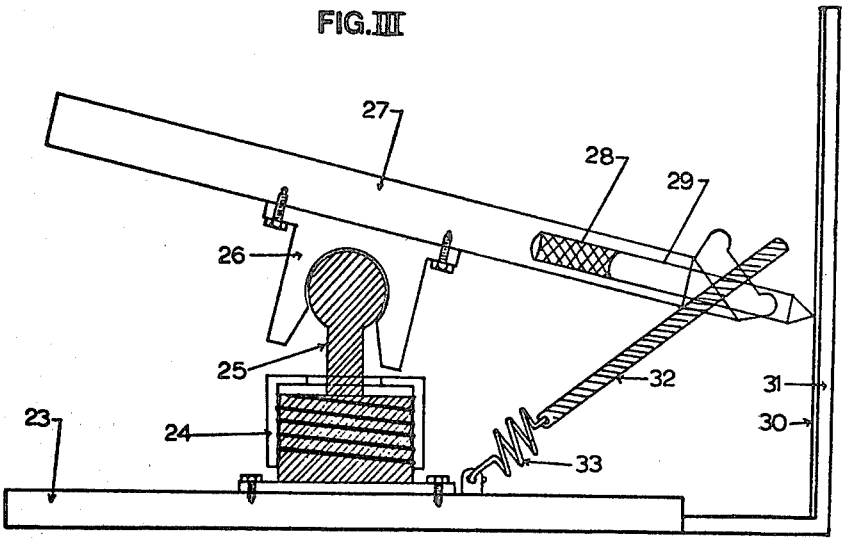
FIG. IV
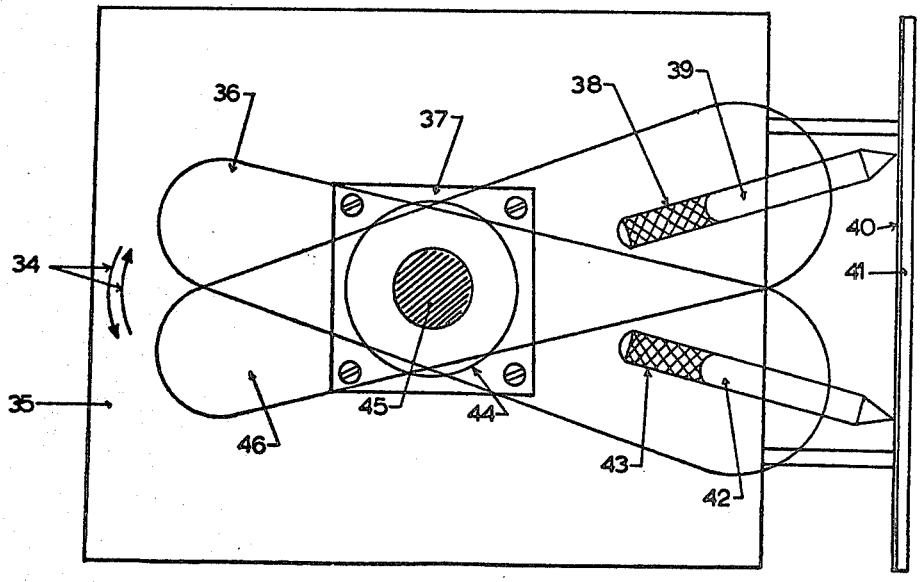

FIG. V
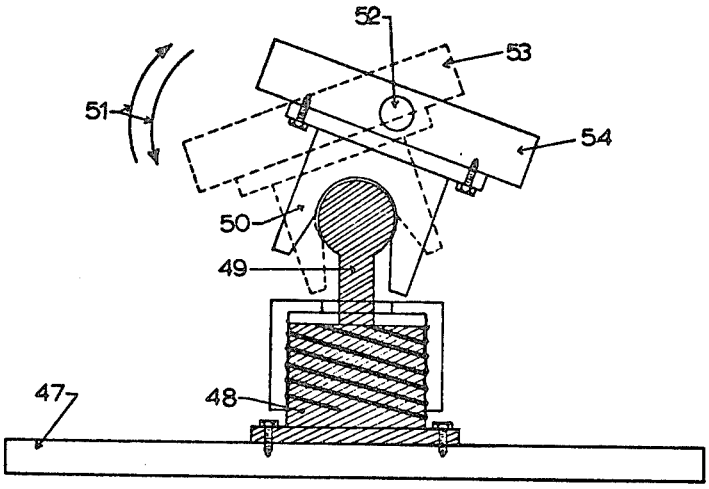
FIG. VI
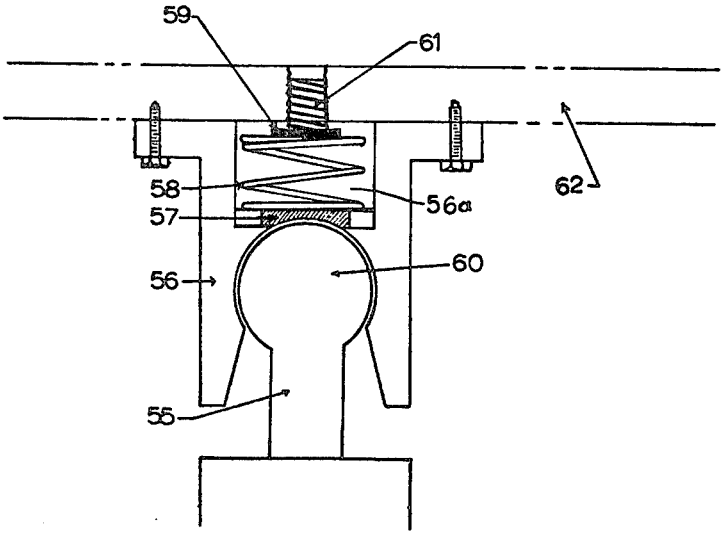

APPARATUS FOR FOOT REHABILITATION

BACKGROUND OF THE DISCLOSURE

In the case of a fracture of the ankle bone as well as in certain cases of ankle sprain or strain, it is generally necessary to secure the ankle against motion in a cast during an appropriate length of time, in order to allow the fractured parts of the bone to knit together and the ligaments to heal.

When this cast is removed, it is often impossible for the patient to rotate the foot, on account of the ankylosis or stiffening caused by the lapse of time of immobility.

To recover the mobility of the foot, it is necessary then to initiate a rehabilitation of the normal motions and this rehabilitation is often left to the patient alone to carry out appropriate exercises of the ankle.

When the patient carries out such exercises in a standing position, the portion of the weight of the body on the injured foot may cause bruising and pain which makes rehabilitation difficult.

When the patient carries out such motions in a sitting or lying position, the suspended position of the leg rapidly produces considerable pain.

DESCRIPTION OF THE INVENTION

To overcome the above difficulties I have conceived a device which may be used by the patient either in a standing position or in a sitting position and which, by a spring system having predetermined tension, compels a certain effort in order to execute rotation and lateral and longitudinal rocking of the foot.

More specifically, my device provides a footrest as a top spherically rotatable portion mounted on a ball-and-socket joint which can, by an adjustable locking system, have mobility ranging from total immobilization to a variety of positions, in every direction.

So that the patient or the doctor in charge of the case may also follow the progress of the rehabilitation, I have, provided the feature that the amount of motion of the patient's foot is limited by a coupling, the positions of which can be adjusted in graded increments in a manner that each increment gives a little more play to the footrest articulation on the ball-and-socket joint, and thus, more mobility to the ankylosed or stiffened foot.

Secondly, the device herein described provides a board on which there is mounted a mobility graph, which is a cross-ruled and numbered paper, so that each possible foot motion is reproduced and scribed on the paper by a pencil fixed to the footrest, the pencil being lightly spring-loaded so that the tip of the pencil is kept in contact with the paper.

The footrest is held in relation to the base of the device by springs the tension of which may be adjusted by tightening of a wing-nut and, according to the number of turns of the wing-nut, there is provided an indication of the amount of force used by the patient to move the footrest.

The spring tension just referred to may be adjusted regularly and should be noted on the cross-ruled paper referred to above so that the patient or the doctor in charge of the case will know the strength used to produce the mobility graph obtained.

DESCRIPTION OF THE FIGURES

The invention will now be described with reference to a preferred embodiment of the invention particularly illustrated in the accompanying drawings wherein, FIG. I shows a partly cross-sectioned elevation view of the device locked in the horizontal position;

FIG. II shows a front view of the mobility graph;

FIG. III shows a side view of the device in an inclined position with the locking system disengaged;

FIG IV shows a top plan view of the device illustrating the horizontal rotation of the footrest;

FIG. V shows a front elevation view of the device illustrating the lateral rocking capability of the footrest;

FIG. VI shows a fragmentary cross-sectional view of the ball-and-socket joint with spring pressure applied.

The embodiment of the device shown in FIG. I includes a base 1 carrying a footrest 8. The base 1 and footrest 8 are interconnected through a ball-and-socket joint made up of ball member 5 and socket member 6.

It is intended that base 1 will rest on the ground or floor. A threaded cylindrical axle 3 equipped with a square bed-plate 3*a* is fixed to the base 1 with four bolts 2. A spherical ball member 5 is fixed in the middle of top of the axle 3. The adjustable coupling 4 has a cylindrical shape and is threaded on its inside to fit over the axle 3. The top of coupling 4 has a hole 4*a* slightly larger than the diameter of the ball member 5. It is on the crown 4*b* of coupling 4 between hole 4*a* and the edge of the coupling 4 that the base of socket member 6 will rest. The base of socket member 6 is denoted as 6*a*.

This base 6*a* is cylindrical and has a diameter approximately the same as that of the axle 3. Socket member 6 swivels on the ball member 5. Socket member 6 is supplied with a square bed-plate 6*b* and bed-plate 6*b* is attached to the footrest 8 by means of four bolts 7.

The footrest 8 is rectangular in shape of sufficient length and width to accommodate a person's foot. Footrest 8 has a cylindrical hole 8*a* toward the front of footrest 8 in which a pencil 10 is inserted. The relative size of hole 8*a* and pencil 10 is such that pencil 10 may slide longitudinally in hole 8*a*. On the forward side of hole 8*a* and in contact with pencil 10 is a spring 9 so that the tip 10*a* of pencil 10 will be held in contact with graph paper 13.

This graph paper 13 is fixed on a board 14 attached at right-angles to base 1.

A tension spiral spring 15 is fixed to base 1 at one end, and to a threaded rod 12 at the other end.

Threaded rod 12 slides through a hole 8*b* at the edge of the footrest 8. A wing-nut 11 permits by its tightening or loosening the adjustment of the tension of spring 15.

As shown in FIG. I, the device is in a fixed position so far as the back and forth or the left-right rocking of this footrest 8 is concerned. Only horizontal motion is possible.

With the adjustable coupling 4 unscrewed, the base 6*a*, being attached to footrest 8 and in contact with the crown 4*b* of coupling 4, renders impossible any oscillation of the ball-and-socket joint of ball member 5 and socket member 6.

FIG. II shows the graph 16 on graph paper 13 which allow the patient and doctor to follow day by day the amplitude of the foot motions that the patient will have done.

Referring to the graph 16, the numbers 17 and the corresponding lines 21, the back and forth rocking of the foot will be observable. With the numbers 18 and the corresponding lines 20, the horizontal motions will be observable. With the numbers 22 and the corresponding circles 19, the left-right side rocking of the foot will be observable.

The analysis of these three observations and the drawing constituted by their combination will determine the degree of mobility of the foot.

The progressive tension of the spring 15 as regulated by wing-nut 11 will be entered on the graph 16 and will give the graph a strength factor in parallel with the exercise accomplished.

FIG. III is a view identical to FIG. I with the exception that the adjustable coupling 24 is tightened on the axis holding the ball member 25.

The base 23 rests on the ground or floor. The socket member 26 firmly attached to the footrest 27, may oscillate freely because of the available play between the bottom portion of part 26 and the top portion of part 24.

The pencil 29, urged forwardly by spring 28 rests on the graph 30 fixed to the board 31 and registers the motions made.

The spring 33 is in FIG. III attached to the base 23 and the threaded rod 32 attached to spring 33 is now loosely held and permits free back and forth rocking motion of the foot.

At the time of a back and forth motion opposite to the one described on the FIG. III, the tip of the pencil 29 will then be directed towards the top and the spring 33 is stretched, demanding from the patient additional effort.

In FIG. IV, the footrest 46 may swivel horizontally on the ball-and-socket member owing to the socket member 37 being in contact with the coupling 44.

The base 35 is seen from the top. When there is a motion shown by the arrows 34, the footrest 46 moves to 36 and the pencil 39 pushed by the spring 38 moves to 42 with the spring 43.

These two positions and each of the intermediate ones are registered on the graph 40 fixed to the board 41.

FIG. V shows the base 47 resting on the ground or floor. The adjustable coupling, tightened to the axis 48 allows the socket member 50 to swivel on the ball member 49.

The patient's foot, as in FIG. III where a back and forth rocking is possible, may also rock from left to right. The footrest 54, following the motion shown by the arrows 51 will be in position 53. The pencil 52 will register this movement.

FIG. VI presents a variation of the device where the socket member 56 is provided on the top with a circular hole 56*a*. Hole 56*a* is provided with a washer 57 of which the bottom portion is just slightly smaller than hole 56*a*, and the top portion of washer 57 is flat.

On this top portion of the washer 57, rests a spiral spring 58 which may move in hole 56*a*.

The top end of this spring rests against a flat washer 59. A hole is threaded in the footrest 62 in a manner that a screw 61 placed in the hole lines up with the centre of the washer 59.

With the device as described in FIG. VI, tension spring 15 or 33 and the threaded rod 12 or 32 are unnecessary because the tightening of screw 61 will compress the spiral spring 58 and will bear more strongly the washer 57 on the ball member 60.

A progressive tightening of screw 61 will require more effort for oscillation, and turn and rocking motions, requiring from the patient more and more effort until the patient's foot flexibility is recovered.

The device I have invented also offers the advantage of being capable of being used under water during hydrotherapy, by means of a waterproof graph paper and indelible pen, for treatment of illnesses or accidents related to foot mobility.

The embodiments of the invention in which an exclusive property or privilege is claimed are defined as follows:

1. A device for the progressive rehabilitation of the human foot after accident or malformation comprising
   - a base,
   - a ball-and-socket joint having a first member fixed to the base and a second member which is spherically rotatable with respect to the first member projecting upwardly therefrom,
   - a footrest fixed to said second member of the ball-and-socket joint whereby the footrest is tiltably and spherically rotatably supported with respect to the base,
   - a marking means supported by the footrest and extended outwardly therefrom for movement therewith relative to the base, whereby the marking means is capable of marking a curved path, and
   - record support means fixed to the base for supporting a markable record in recording proximity to the marking means whereby a permanent record of non-linear, rotating movement of the footrest with respect to the base can be generated, the permanent record having at least two dimensions.

2. The device of claim 1 wherein said first member of the ball-and-socket joint is a ball and said second member is a socket partially enveloping the ball.

3. The device of claim 2 further comprising adjustable spring means internally mounted in relation to the ball-and-socket joint so as to adjust the resistance to tiltable motion of the footrest relative to the base.

4. The device of claim 2 further comprising spring means attached to the base, a threaded rod attached to the spring means, and threaded fastening means engaging the threaded rod and footrest for adjustably attaching the footrest to the threaded rod.

5. The device of claim 1 wherein the mark means further comprises biasing means for biasing the marking means toward marking engagement with the record support means.

6. The device of claim 1 further comprising a markable record sheet situated on a face of the record support in markable engagement with the marking means.

7. The device of claim 6 wherein the markable record is a sheet of graph paper.

8. The device of claim 1 wherein said record support means is a planar surface fixed at right angles to said base and extending upwardly therefrom beside the footrest above the mean height of the footrest.

9. A device for the progressive rehabilitation of the human foot after accident or malformation comprising,
   - a base,
   - a ball-and-socket joint having a ball fixed to the base and a socket partially enveloping the ball which is movable with respect to the ball projecting upwardly therefrom,
   - a footrest fixed to said socket, the socket containing a hole which extends from the footrest to the ball, and the footrest containing a circular threaded hole located above the hole in the socket, the axis of the threaded hole being perpendicular to the footrest, whereby the footrest is tiltably supported with respect to the base, a marking means supported by the footrest and extended outwardly therefrom, record support means fixed to the base for supporting a markable record in recording proximity to the marking means whereby a permanent record of movement of the footrest with respect to the base can be generated, and adjustable spring means internally mounted in relation to the ball-and-socket joint so as to adjust the resistance to tiltable motion of the footrest relative to the base, the adjustable spring means comprising:

A first washer resting on the ball,

A spiral spring resting on the first washer, the spring having an axis perpendicular to the footrest, A second washer resting on an upper end of the spring, A screw engaged in the threaded hole of the footrest, the screw having a lower end in contact with the second washer.

10. A device for the progressive rehabilitation of the human foot after accident or malformation comprising;

a base, a ball-and-socket joint having a ball fixed to the base and a socket partially enveloping the ball which is movable with respect to the ball projecting upwardly therefrom, a footrest fixed to said socket whereby the footrest is tiltably supported with respect to the base, a marking means supported by the footrest and extended outwardly therefrom, record support means fixed to the base for supporting a markable record in recording proximity to the marking means whereby a permanent record of movement of the footrest with respect to the base can be generated, and adjustable spring means internally mounted in relation to the ball-and-socket joint so as to adjust the resistance to tiltable motion of the footrest relative to the base, the adjustable spring means comprising a first washer resting on the ball, a spiral spring resting on the first washer, the spring having an axis perpendicular to the footrest, a second washer resting on an upper end of the spring, and a screw threadedly engaged in the footrest, the screw being perpendicular to the footrest, and having its lower end in contact with the second washer.

11. The device of claim 10 wherein the marking means further comprises biasing means for biasing the marking means toward marking engagement with the record support means.

12. The device of claim 10 further comprising a markable record sheet situated on a face of the record support means in markable engagement with the marking means.

13. The device of claim 12 wherein the markable record is a sheet of graph paper.

14. The device of claim 10 wherein said record support means is a planar surface fixed at right angles to said base and extending upwardly therefrom beside the footrest above the mean height of the footrest.

15. A device for the progressive rehabilitation of the human foot after accident or malformation comprising:

a base, a ball-and-socket joint having a first member fixed to the base and a second member which is movable with respect to the first member projecting upwardly therefrom, a footrest fixed to said second member of the ball-and-socket joint whereby the footrest is tiltably supported with respect to the base, a marking means supported by the footrest and extended outwardly therefrom, record support means fixed to the base for supporting a markable record in recording proximity to the marking means whereby a permanent record of movement of the footrest with respect to the base can be generated, adjustable biasing means internally mounted in relation to the ball-and-socket joint so as to adjust the resistance to tiltable motion of the footrest relative to the base, the adjustable biasing means comprising a friction element in tangential contact with the ball, a biasing means within the socket which applies a normal force to the friction element, an adjusting means which adjusts the amount of normal force applied on the friction element by the biasing means.

16. The device of claim 15 wherein said first member of the ball-and-socket joint is a ball and said second member is a socket partially enveloping the ball.

17. The device of claim 15 wherein the marking means further comprises a second biasing means for biasing the marking means toward marking engagement with the record support means.

18. The device of claim 15 further comprising a markable record sheet situated on a face of the record support means in markable engagement with the marking means.

19. The device of claim 18 wherein the markable record is a sheet of graph paper.

20. The device of claim 15 wherein said record support means is a planar surface fixed at right angles to said base and extending upwardly therefrom beside the footrest above the mean height of the footrest.

* * * * *